United States Patent [19]

Wilson

[11] 4,030,305

[45] June 21, 1977

[54] METHOD OF MOVING A FLOATING BODY INTO A PREDETERMINED FLOAT PATH

[75] Inventor: Leland Earl Wilson, Vanlose, Denmark

[73] Assignee: Atlantic Richfield Company, Los Angeles, Calif.

[22] Filed: Sept. 23, 1976

[21] Appl. No.: 725,823

[52] U.S. Cl. ..... 61/1 R; 61/6; 61/103; 114/244

[51] Int. Cl.[2] ..... E02B 15/00; B63B 51/00

[58] Field of Search ..... 61/1, 6, 103; 114/40, 114/41, 42, 242, 244

[56] References Cited

UNITED STATES PATENTS

| | | | |
|---|---|---|---|
| 3,289,415 | 12/1966 | Merrill | 61/1 R |
| 3,915,450 | 10/1975 | Flewwelling et al. | 61/6 X |
| 3,931,715 | 1/1976 | Fitch et al. | 61/103 |

*Primary Examiner*—Jacob Shapiro
*Attorney, Agent, or Firm*—Roderick W. MacDonald

[57] ABSTRACT

A method for moving a floating body into a predetermined float path which is different from that bodies natural drift path by reducing the density of the liquid in which said body is floating, the reduction in density being generally in the direction of said predetermined float path.

5 Claims, 2 Drawing Figures

METHOD OF MOVING A FLOATING BODY INTO A PREDETERMINED FLOAT PATH

BACKGROUND OF THE INVENTION

This invention is hereafter described, for sake of clarity and brevity only, in terms of an iceberg floating in an ocean or sea of salt water. It is to be understood at the outset, however, that this invention broadly applies to any body floating in a liquid wherein it is desired to redirect the floating body from its natural drift path to a different predetermined float path. It is also to be understood that although this invention is particularly desirable for the redirection of exceedingly large, ponderous floating bodies which are not easily moved by physical means, this invention is equally adaptable to the redirection of drift path of small floating bodies as well.

Heretofore it has been desirable to move floating icebergs from their natural drift path when that drift path will cause the iceberg to collide with a fixed man-made or other obstacle. Such a redirection of drift path of an iceberg into a predetermined safer float path has been achieved by physical devices such as tow lines, slings, nets, harnesses, and the like physically attached to the iceberg, the opposite end of the tow lines, etc. being connected to a ship, tug, and the like which then literally pulls the iceberg into its desired predetermined float path. Some ships and tugs are also equipped to push icebergs. Such a concept is disclosed in relation to artificial ice islands in U.S. Pat. No. 3,931,715.

Icebergs are often of such ponderous size that they require a substantial amount of time and effort merely to install physical tow lines and the like, not to mention the expense and wear on the ship that has to move the iceberg by brute force, sometimes over very long distances. Further, when an iceberg reaches a large size or is of a critical dimension or configuration, it can tumble in the water thereby throwing off towlines, slings, and the like and this can make such approaches dangerous as well as time consuming and expensive.

SUMMARY OF THE INVENTION

According to this invention there is provided a method for moving a body in a predetermined float path which is different from the body's natural drift path without the use of physical attachments to the body nor the use of brute force to redirect the body from its natural drift path. This is accomplished by this invention by reducing the density of the liquid in which the body is floating, the reduction in density being achieved generally in the direction of said predetermined float path. The area of liquid which is reduced in density thereby provides a path of lesser resistance for travel for said body than the surrounding liquid which is of normal density so that the body will tend to tumble toward and/or sink deeper toward the less dense liquid. Accordingly, by the practice of this invention a floating body naturally moves on its own in the desired predetermined float path without resort to physical brute force. By this invention the floating body is led in the desired direction rather than forced in that direction.

Accordingly, it is an object of this invention to provide a new improved method for moving a solid body in a predetermined float path which is different from that body's natural drift path. It is another object to provide a new and improved method for leading icebergs into a safer float path.

Other aspects, objects and advantages of this invention will be apparent to those skilled in the art from this disclosure and the appended claims.

DETAILED DESCRIPTION OF THE INVENTION

Figure 1:
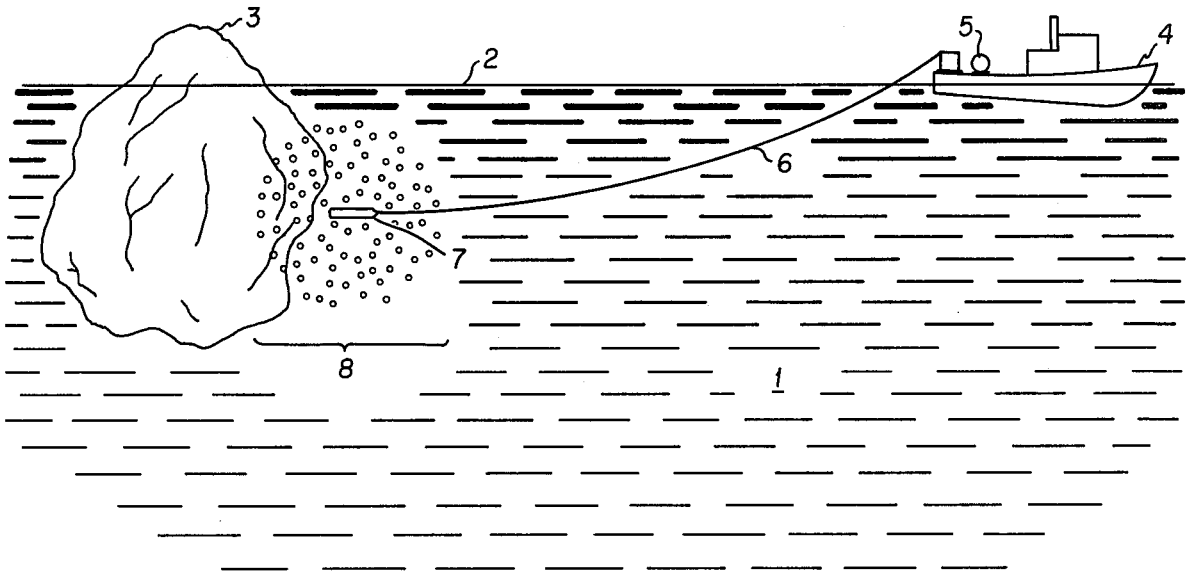
FIG. 1 shows a side view of one way of carrying out the method of this invention.

More specifically, FIG. 1 shows the ocean 1 with its waterline 2 and an iceberg 3 floating therein. A ship 4 carries on it an air compressor 5 which is connected to hose 6, the trailing end of hose 6 carrying a submerged nozzle 7 with aeration jets thereon so as to bubble air into area 8 and thereby reduce the density of the sea water in area 8 relative to the rest of the water surrounding iceberg 3.

Figure 2:
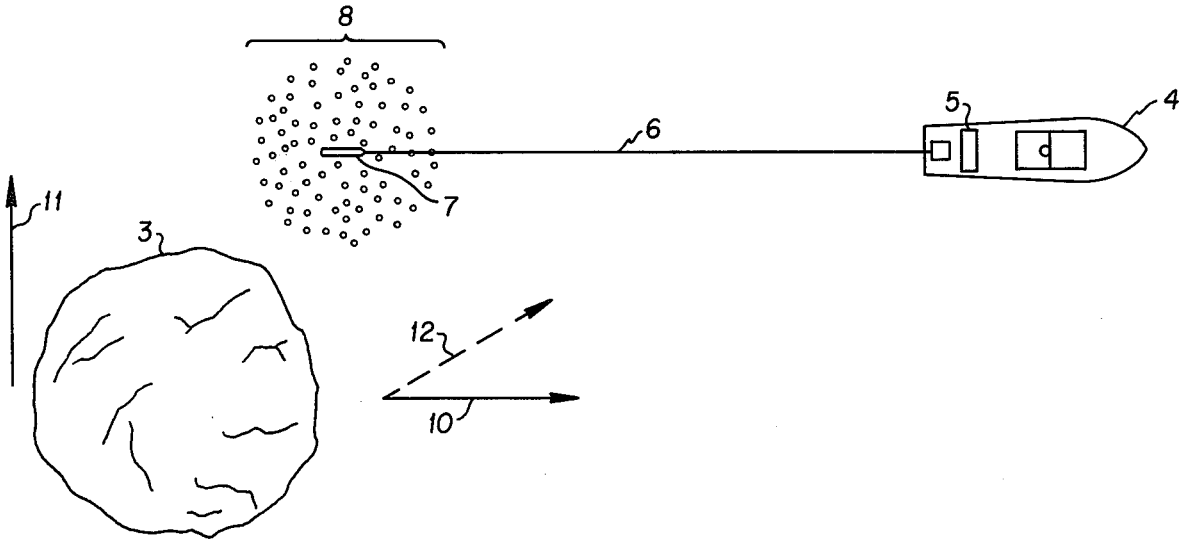
FIG. 2 shows a top view of FIG. 1.

It can be seen from FIG. 2 that if the natural drift direction of iceberg 3 is in the direction shown by arrow 10, that by aerating the water in area 8, iceberg 3 will see a path of lesser resistance to travel in the direction of arrow 11 and naturally tend to move in the direction of area 8. Thus, by reducing the density of the water in a direction generally in the direction of the predetermined flow path (not necessarily in the exact direction of the predetermined float path) iceberg 3 can be deflected into the desired float path 12 and around any obstacle that it was on a collision course with had it been allowed to maintain its natural drift direction 10. Only slight changes in the drift direction of the iceberg, when made well ahead of the object to be avoided, can result in large deflection distances at that object.

Any floating body in any liquid can be led in the manner contemplated by the concept of this invention utilizing any desired liquid density reduction means. For example, any type of gas or even an appropriate liquid could be employed to generate area 8 of reduced density relative to the rest of the liquid surrounding iceberg 3. Also, the means for injecting or otherwise introducing the density reducing medium into the liquid which is supporting the floating body can vary widely and will be readily apparent to those skilled in the art once the concept of this invention is made known to them.

Reasonable variations and modifications are possible within the scope of this disclosure without departing from the spirit and scope of this invention.

The embodiments of the invention in which an exclusive property or privilege is claimed are defined as follows:

1. In a method for moving a body in a predetermined float path which is different from said body's natural drift path, said body floating in a liquid, the improvement comprising reducing the density of the liquid in which said body is floating, said reduction in density being generally in the direction of said predetermined float path, thereby providing a path of lesser resistance for travel for said body, said path of lesser resistance being in the general direction of said predetermined float path.

2. The method of claim 1 wherein said body is ice floating in water, and the density of said water is reduced by injecting a gas thereinto near said ice body.

3. The method of claim 2 wherein said ice body is an iceberg and is floating in salt water.

4. The method of claim 3 wherein said gas is air.

5. The method of claim 4 wherein said air is bubbled into said salt water from a ship, said ship moving in the general direction of said predetermined float path.

* * * * *